US006555203B1

(12) United States Patent
Karlsson

(10) Patent No.: US 6,555,203 B1
(45) Date of Patent: Apr. 29, 2003

(54) CAMOUFLAGE MATERIAL

(75) Inventor: Lars Karlsson, Gamleby (SE)

(73) Assignee: Barracuda Technologies AB (SE)

( * ) Notice: Subject to any disclaimer, the term of this patent is extended or adjusted under 35 U.S.C. 154(b) by 0 days.

(21) Appl. No.: 09/786,607

(22) PCT Filed: Sep. 3, 1999

(86) PCT No.: PCT/SE99/01528

§ 371 (c)(1),
(2), (4) Date: Apr. 27, 2001

(87) PCT Pub. No.: WO00/17599

PCT Pub. Date: Mar. 30, 2000

(30) Foreign Application Priority Data

Sep. 7, 1998 (SE) ..... 9803018

(51) Int. Cl.[7] ..... B32B 1/00
(52) U.S. Cl. ..... 428/178; 428/166; 428/919
(58) Field of Search ..... 428/156, 166, 428/174, 919, 178

(56) References Cited

U.S. PATENT DOCUMENTS

| | | | | |
|---|---|---|---|---|
| 3,836,967 A | | 9/1974 | Wright | |
| 4,287,250 A | * | 9/1981 | Rudy | 428/166 |
| 4,465,731 A | | 8/1984 | Pusch et al. | |
| 4,496,950 A | | 1/1985 | Hemming et al. | |

FOREIGN PATENT DOCUMENTS

| | | |
|---|---|---|
| DE | 2558050 | 6/1977 |
| SE | 408226 | 5/1979 |
| WO | WO8703082 | 5/1987 |
| WO | WO8906338 | 7/1989 |

* cited by examiner

*Primary Examiner*—Donald J. Loney
(74) *Attorney, Agent, or Firm*—Dann, Dorfman, Herrell and Skillman, P.C.

(57) ABSTRACT

The invention regards a material having a three-dimensional surface built up by bulgings arranged regularly or irregularly mutually adjacently, and which have approximately conical form. It is thus accomplished that the brightness of the material is little dependent on the view angle, in contrast to what is the case with plane surfaces, even if painted with matte camouflage paint.

11 Claims, 2 Drawing Sheets

CAMOUFLAGE MATERIAL

The invention regards a camouflage material having a three-dimensional surface structure, consisting of mutually adjacent bulgements that are pointed.

Three-dimensional surface structures for camouflage purposes are previously known. An example is U.S. Pat. No. 3,069,796, which demonstrates camouflage layers which are cut in a particular way such that when stretched they assume a foliage-like structure. Another example is U.S. Pat. No. 3,836,967, which shows a radar camouflage having a multitude of similar hollow tapered pyramid-formed projections which are packed to each other and form a kind of a conducting layer.

A particular problem when camouflaging illuminated objects (including reconnaissance means in both visible and invisible light) is the difficulty of obtaining something, which resembles nature in all. A particular difficulty is that prior art camouflage surfaces appear so differently in different angles of regarding and illumination respectively. Thus, a grass surface has about the same colour and not so big difference in brightness seen against the light in comparison to light falling in at 90° or seen in the light direction. For instance, a painted tin plate will show itself very bright seen against the light, and this independent of how good and matte a camouflage paint is used to cover the tin plate.

It is for instance shown in practice that a construction such as that shown in U.S. Pat. No. 3,836,967 is rather inappropriate for the disguise or camouflage purpose of the present invention, since its three-dimensional structure is composed from plane surfaces, which give a specular reflection, which is without importance for the use envisaged therewith, which is for radar camouflage. In visible light and e.g. the near infrared, the aspect will be far from natural.

The problem of the invention is solved according to the present invention by obtaining a three-dimensional surface that in every direction has a minimum of plane, specularly reflective surfaces. More specifically, the invention regards a camouflage material having a three-dimensional surface structure consisting of mutually adjacent pointed bulgings, characterized in having curved surfaces in essentially all sight directions.

The bulgings being stated as pointed is to be understood such that some section through them will form a sectional curve that at the top is essentially angular but can be somewhat rounded. Endings as more or less pronounced apices or edges are however preferred. If they are made as pointed, the point itself in practice will be somewhat rounded, which is also true for an edge form.

According to a preferred embodiment, the bulgings are essentially conical bulgings. With cones are to be understood according to the invention such forms which can be described by a point, a closed directrix curve which may be arbitrary or a polygon made of straight or curved lines, a circle, an ellipse, etc. and a generatrix. In the most common cases, a generatrix is a straight line, but according to the more general definition intended here, it is possible for a generatrix to be used also a curved line.

The essential is that the bulging will show up in practically all directions as curved surfaces. Simply curved surfaces will then give a specular reflection along a line. Doubly curved surfaces will give a specular reflection only in a point.

In a preferred embodiment, bulgings are used having a directrix which is circular or near circular. It is also preferred to use essentially straight lines as generatrices. According to a preferred embodiment, they will also have such angles of clearance that they easily release from a mold when made by molding.

In addition to the visual effect, it is also possible to obtain a radar camouflage effect, for example by arranging under the three-dimensional structure of a layer having radar absorption properties, which is accomplished by arranging the surface resistance as known from U.S. Pat. No. 3,733,606. Also colouring or the like with different kinds of prior art camouflage dyes is possible, as arranging favourable properties in other radiation wavelength intervals.

The invention shall now be described by example and appertaining figures.

FIGS. 3A and 3B and FIGS. 4A and 4B respectively show colour recordings for a camouflage painted tin plate and a surface according to the invention respectively.

Figure 1:
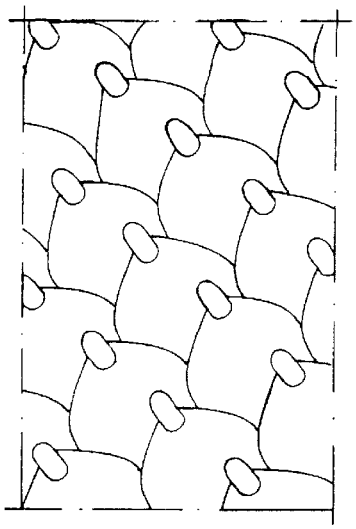
FIG. 1 shows an example of a camouflage material according to the invention.

In FIG. 1 is shown a non-limiting example of a camouflage material of the kind designated by the invention. On a surface are moulded plastic cones having a height of 5 mm and about 60° cone angle and in displaced rows having a mutual distance of 5 mm. In this case, the symmetry is hexagonal, there being six nearest neighbours to each cone. Alternatively, they may be ordered in quincunx position, i.e. with four nearest neighbours to each cone.

The cone-formed bulgings can also be in a more random disorder, even if an ordered structure is preferred, not least for reasons of manufacture. Further, the sizes of the cones may vary within relatively large limits, as from the height of 1 mm to 50 mm. The height of 5 mm is a suitable balance value in view of tolerance of dirt, which is diminished with small cones, and material consumption and weight, which increase with larger cones.

Figure 2:
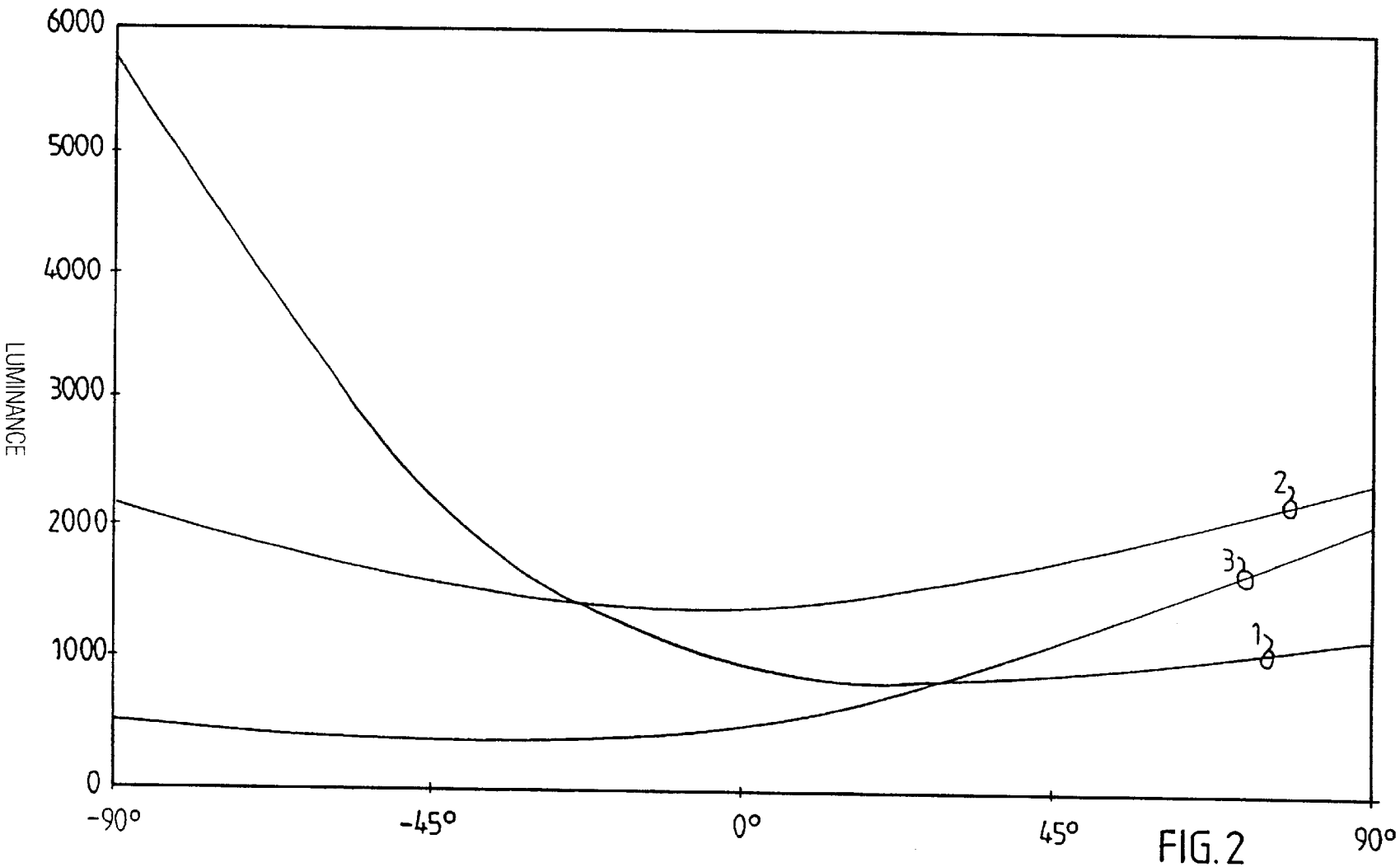
FIG. 2 shows a comparison of brightness for different angles of view of a camouflage painted tin plate, a natural grass surface and a camouflage material built up from cones.

FIG. 2 shows a diagram where luminance has been measured as a function of the view angle, measured between grazing incidence and against the light (−90°) and grazing incidence and along the light (+90°), for three different surfaces: The curve 1 designates a tin plate surface painted with a matte camouflage paint, curve 2 a natural grass surface and curve 3 a surface such as shown in FIG. 1. The luminance is reproduced in arbitrary but linear units. The measurements were made in sunlight on a grass lawn, with for curve 1 a painted tin plate laid upon the ground, and for the curve 3 a plate with cones according to the invention, laid in the same way upon the ground.

It is seen from the figures that the painted tinplate is particularly unfavourable in counter light. Hardly any object in nature, excepting possibly water surfaces, show such brightness in counter light. In view of the fact that just tin plate surfaces and the like are the most common of that military material which needs camouflaging, it is clear that an improvement in this respect is of great importance.

The grass surface, corresponding to curve 2, must be considered as that which is most desirable to attain. Relative to this, the exemplary construction as of curve 3 is a satisfactory imitation.

The exemplary construction used is made from opaque material. The increase in luminance observed in the forward light direction is dependent thereof; a grass surface consists of leaves that have a certain transparency. If the cone material is made somewhat transparent, the result will be more natural. In a preferred embodiment therefore, the cones are made of some transparent material, and preferentially hollow.

Figure 3A:
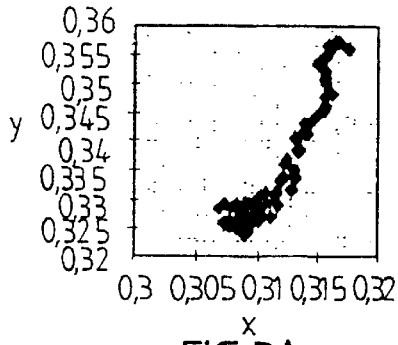
Figure 4A:
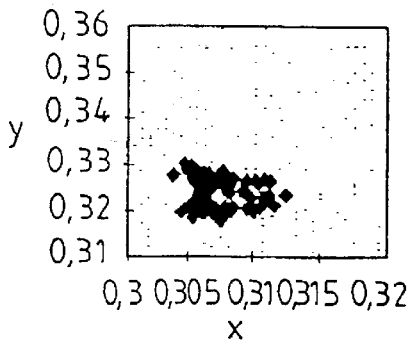
Figure 3B:
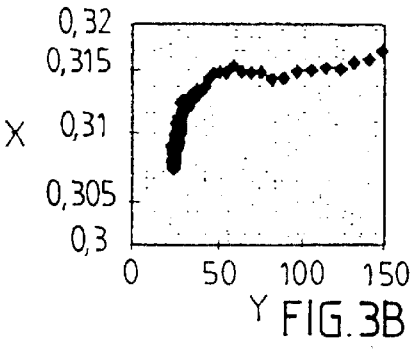

FIGS. 3A, 3B show colour diagrams regarding painted tin plate measured at different sight angles. FIG. 3A thus shows in a diagram according to CIE 1931 that the camouflage painted plate changes colour when changing the angle of sight between grazing counter light and grazing forward light. FIG. 3B shows with the same x-axis as in FIG. 3A the luminosity (scale arbitrary but linear) when the angle is changed from grazing forward light (leftmost) to counter light (rightmost in the diagram). As a comparison, FIGS. 3A and 3B show similar measurements for a surface having cones according to the invention. The inventive surface thus has considerably better properties both as to brightness and colour for varying sight angles. All those diagrams were recorded by means of a Minolta Chromameter, mod. CS 100.

Figure 4B:
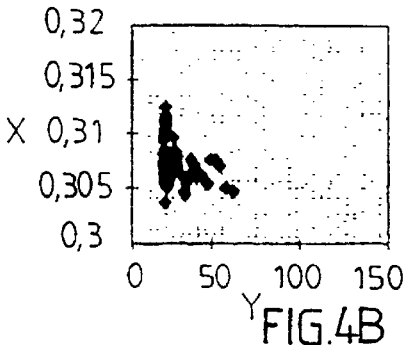

From those diagrams thus appears that there are also rather great changes in colour when the angle of sight is changed. FIG. 3B and FIG. 4B corroborate the result shown in FIG. 2.

The intended three-dimensional structure can be manufactured in many ways, as will be understood by the man of the art knowledgeable in plastics. One way is by moulding, another by embossing of a sheet, preferentially afterwards mounted upon a carrier sheet which can be woven or a plastic sheet. It is also possible to make this structure from metal.

Although the invention has been exemplified with a structure having certain dimensions, it is clear that those may be varied in different ways, depending upon the purpose. The inventive effect is obtained also with the same structure in greater or smaller scale. Great scale and massive embodiment will lead to great material consumption and a pattern visible at near distance. At small scale, there may be difficulties of manufacture, as well as difficulties in cleaning.

Depending on the circumstances, the surface may be dyed with different camouflage dyes/paints, such as summer colours, winter colours or desert colours. Those dyes/paints should have camouflage properties within a large wavelength interval, from UV up to and within the near infrared interval. The material may be made self-supporting or be affixed to e.g. vehicles or tanks.

Further, this material may be used for partly covering surfaces, or be made less regular than as has been exemplified.

What is claimed is:

1. Camouflage material having an optical camouflage effect, having a three-dimensional surface structure consisting of mutually adjacent bulgings, characterized in that said bulgings are pointed and have curved surfaces in essentially all sight directions.

2. Camouflage material according to claim 1, characterized in that the said bulgings are essentially circularly conical bulgings.

3. Camouflage material according to claim 2, characterized in that said circularly conical bulgings have straight-line generatrices.

4. Camouflage material according to claim 2, characterized in that said bulgings have generatrices that are curved lines.

5. Camouflage material according to claim 1, characterized in that the bulgings are cones having directrices that are polygons of straight lines and generatrices that are curved.

6. Camouflage material according to any one of the preceding claims, characterized in that the bulgings are regularly ordered quincuncially, having four nearest neighbours to each bulging.

7. Camouflage material according to any one of claims 1–5, characterized in that the bulgings are regularly ordered in a hexagon pattern, having six neighbours to each bulging.

8. Camouflage material according to claim 1 characterized in that its bulgings are at least partially transparent.

9. Camouflage material according to claim 1 characterized in that it is made from a plastic or elastomer material.

10. Camouflage material according to claim 1 characterized in that it contains electrically conducting material and/or magnetic material.

11. Camouflage material according to claim 10, characterized in that the electrically conducting material is arranged in a carrier structure which is arranged on the under side and carries the bulgings.

* * * * *